US009425507B1

(12) United States Patent
Lee

(10) Patent No.: US 9,425,507 B1
(45) Date of Patent: Aug. 23, 2016

(54) STRUCTURE OF EXPANDABLE MULTI-MODE PHASED-ARRAY ANTENNA

(71) Applicant: XMW INC., Daejeon (KR)

(72) Inventor: Moohong Lee, Daejeon (KR)

(73) Assignee: XMW INC., Daejeon (KR)

( * ) Notice: Subject to any disclaimer, the term of this patent is extended or adjusted under 35 U.S.C. 154(b) by 3 days.

(21) Appl. No.: 14/696,547

(22) Filed: Apr. 27, 2015

(30) Foreign Application Priority Data

Feb. 2, 2015 (KR) ..... 10-2015-0016082

(51) Int. Cl.
*H01Q 21/00* (2006.01)
*H01Q 3/36* (2006.01)
*H01Q 1/02* (2006.01)

(52) U.S. Cl.
CPC ... *H01Q 3/36* (2013.01); *H01Q 1/02* (2013.01)

(58) Field of Classification Search
CPC ..... H01Q 3/36; H01Q 1/02
See application file for complete search history.

(56) References Cited

U.S. PATENT DOCUMENTS 6,580,402 B2 * 6/2003 Navarro ..... H01Q 21/0025 333/137
6,677,899 B1 * 1/2004 Lee ..... H01Q 3/36 342/372
6,906,679 B2 * 6/2005 Kneisel ..... H01Q 1/08 343/816
7,979,144 B2 * 7/2011 Rajendran ..... B23K 26/032 219/121.68
2002/0180655 A1 * 12/2002 Mohuchy ..... H01Q 13/085 343/770
2010/0171674 A1 * 7/2010 Henderson ..... H01Q 21/0037 343/778

FOREIGN PATENT DOCUMENTS

KR 10-2013-0041697 A 4/2013

* cited by examiner

*Primary Examiner* — Trinh Dinh
(74) *Attorney, Agent, or Firm* — Paratus Law Group, PLLC

(57) ABSTRACT

Disclosed is a phased-array antenna. The phased-array antenna includes a plurality of element antennas having feed lines formed thereon, antenna modules configured to extend and be disposed in longitudinal directions of the element antennas and independently connected to one ends of the plurality of element antennas, respectively, and a signal distribution module disposed in a direction perpendicular to the antenna modules, having one side surfaces being perpendicularly connected to each of the antenna modules, and configured to distribute an input signal to the corresponding antenna modules through connection pins whose one sides are respectively connected to the antenna modules.

6 Claims, 6 Drawing Sheets

STRUCTURE OF EXPANDABLE MULTI-MODE PHASED-ARRAY ANTENNA

STATEMENT REGARDING SPONSORED RESEARCH AND DEVELOPMENT

This work (Project number: B0101-15-1372; Project Name: Development of Mobile Multi-mode Transmission Technology based on Spatial Spreading) was supported by ICT R&D program sponsored by Ministry of Science, ICT and Future Planning (MSIP) of Republic of Korea and Institute for Information and Communication Technology Promotion (IITP) of Republic of Korea.

CROSS-REFERENCE TO RELATED APPLICATION

This application claims priority to and the benefit of Korean Patent Application No. 2015-0016082, filed on Feb. 2, 2015, the disclosure of which is incorporated herein by reference in its entirety.

BACKGROUND

1. Field of the Invention

The present invention relates to a structure of a multi-mode phased-array antenna which is used for a wireless communication and a radar.

2. Discussion of Related Art

Recently, since the need to simultaneously track a plurality of targets moving at high speed over long distances has been increased significantly, the use of a phased-array antenna with an accompanying high power phase shifter has been increased significantly.

The phase shifter is an apparatus configured to shift the phase of an electromagnetic wave to be transmitted, and is mainly used to adjust a phase of each radiating element of the phased-array antenna electrically steering an antenna beam.

The phased-array antenna may be configured with a plurality of radiating elements, a phase shifter, an amplifier, a signal distributor, and the like. This phased-array antenna of the related art is disclosed in Korea Laid-Open Patent Publication No. 2013-0041697. At this time, elements may be connected to each other through RF connectors and cables for signal transmission.

Then, since the number of required RF connectors and cables is increased exponentially as the number of elements is increased, the size of the phased-array antenna is increased. In addition, there is problem in that the loss of the phased-array antenna occurs due to the RF connector and cable, and the performance thereof is degraded. Therefore, a phased-array antenna is needed to improve the problem described above and to miniaturize the size thereof.

SUMMARY OF THE INVENTION

The present invention is directed to a phased-array antenna in which a plurality of element antennas and antenna modules are three-dimensionally disposed and perpendicularly coupled to a signal distribution module using connection pins.

In addition, the present invention is also directed to the phased-array antenna in which the number of elements thereof is changed easily and a plurality of modes may be implemented since a plurality of signal distributors are horizontally stacked.

According to an aspect of the present invention, there is provided a phased-array antenna, including: a plurality of element antennas having feed lines formed thereon; antenna modules configured to extend and be disposed in longitudinal directions of the element antennas and independently connected to one ends of the plurality of element antennas, respectively; and a signal distribution module disposed in a direction perpendicular to the antenna modules, having one sides being perpendicularly connected to each of the antenna modules, and configured to distribute an input signal to the corresponding antenna modules through connection pins whose one sides are respectively connected to the antenna modules.

In the signal distribution modules, the number of signal distributors the same as the number of transmission modes to be transmitted by the phased-array antenna may be stacked and screw-coupled.

Each of the signal distributors may include a substrate having a signal connector configured to receive the input signal and connection pins which transmit distribution signals distributed from the signal connector to the corresponding antenna modules, and a cover stacked on the substrate to protect and support the substrate, wherein the substrate and cover may be screw-coupled.

In the signal distributors, one side of the connection pin formed on the substrate may be coupled to the corresponding antenna module, and the signal connector may pass and be exposed through the cover formed on an outermost side thereof.

Locations of the connection pins and the signal connector formed on the substrates of each of the signal distributors may be spaced apart from each other not to overlap vertically.

The phased-array antenna may further include a heat pipe, and the plurality of antenna modules may be spaced apart from each other and perpendicularly coupled to an edge of one side of the signal distribution module to form a three-dimensional space, and the heat pipe may pass through the three-dimensional space and the signal distribution module and protrude from an outer side of the signal distribution module.

The antenna module may include a phase shifter or a phase shifter and amplifying circuit.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
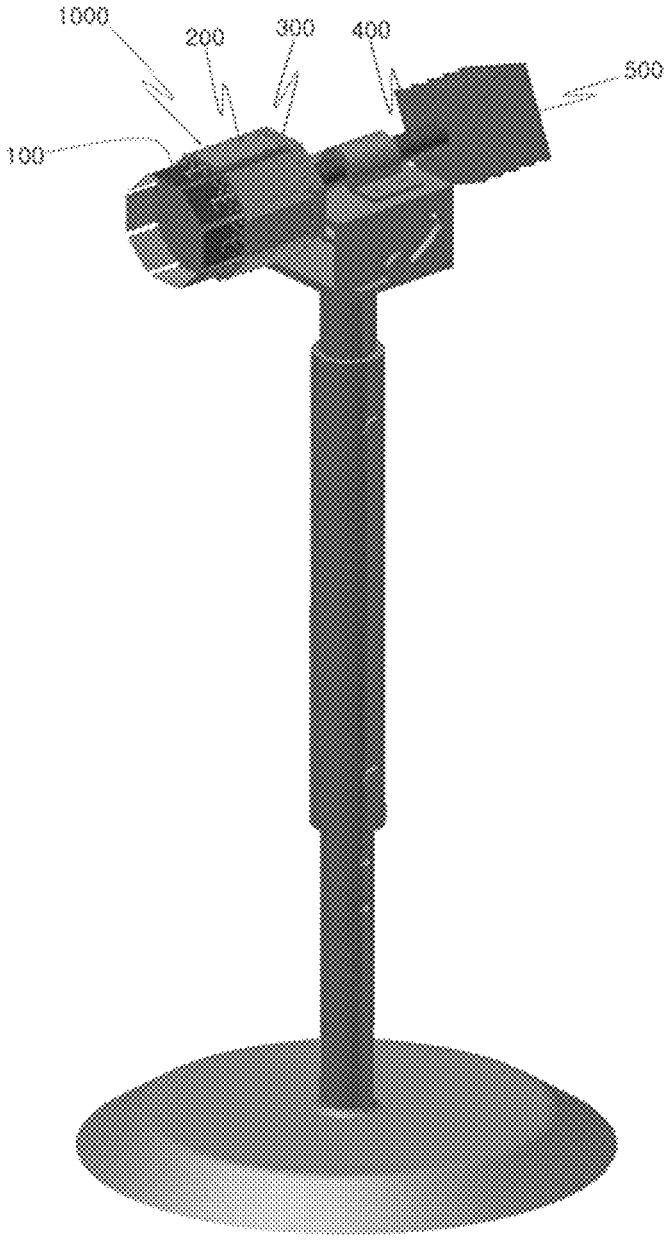
FIG. 1 is a view illustrating as phased-array antenna according to an embodiment of the present invention.

While the invention is susceptible to various modifications and alternative forms, specific embodiments thereof are shown by way of example in the drawings and will herein be described in detail. It should be understood, however, that there is no intent to limit the invention to the particular forms disclosed, but on the contrary, the invention is to cover all modifications, equivalents, and alternatives falling within the spirit and scope of the invention. Like numbers refer to like elements throughout the description of the figures.

Like numbers refer to like elements throughout the description of the figures. In detailed descriptions of operation principles of the exemplary embodiments of the invention, when it is determined that detailed descriptions of related well-known functions and configurations unnecessarily obscure the gist of the invention, detailed descriptions thereof will be omitted.

It will be understood that, although the terms "first," "second," etc. may be used herein to describe various elements, these elements should not be limited by these terms. These terms are only used to distinguish one element from another.

For example, a first element could be termed a second element, and, similarly, a second element could be termed a first element, without departing from the scope of the present invention.

As used herein, the term "and/or" includes any and all combinations of one or more of the associated listed items.

It will be understood that when an element is referred to as being "connected" or "coupled" to another element, it can be directly connected or coupled to the other element or intervening elements may be present.

In contrast, when an element is referred to as being "directly connected" or "directly coupled" to another element, there are no intervening elements present.

The terminology used herein is for the purpose of describing particular embodiments only and is not intended to be limiting of the invention.

As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs.

It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, a phased-array antenna according to an exemplary embodiment of the present invention will be described in detail with reference to the accompanying drawings FIGS. 1 to 9. In the below description of the present invention, the well-known description of the related art will be omitted or simplified in order to dearly explain the gist of the present invention.

FIG. 1 is a view illustrating a phased-array antenna according to an embodiment of the present invention. A phased-array antenna 1000 according to the embodiment of the present invention may include element antennas 100, antenna modules 200, a signal distribution module 300, and a heat pipe 400, and further include a heat sink 500 on an end of the heat pipe 400. The phased-array antenna 1000 according to the embodiment of the present invention may be connected to the heat pipe 400 and a direction controller to adjust horizontal rotating and an angle, and vertically movable by a supporter which supports the direction controller, and the supporter may be supported by a stand.

Figure 2:
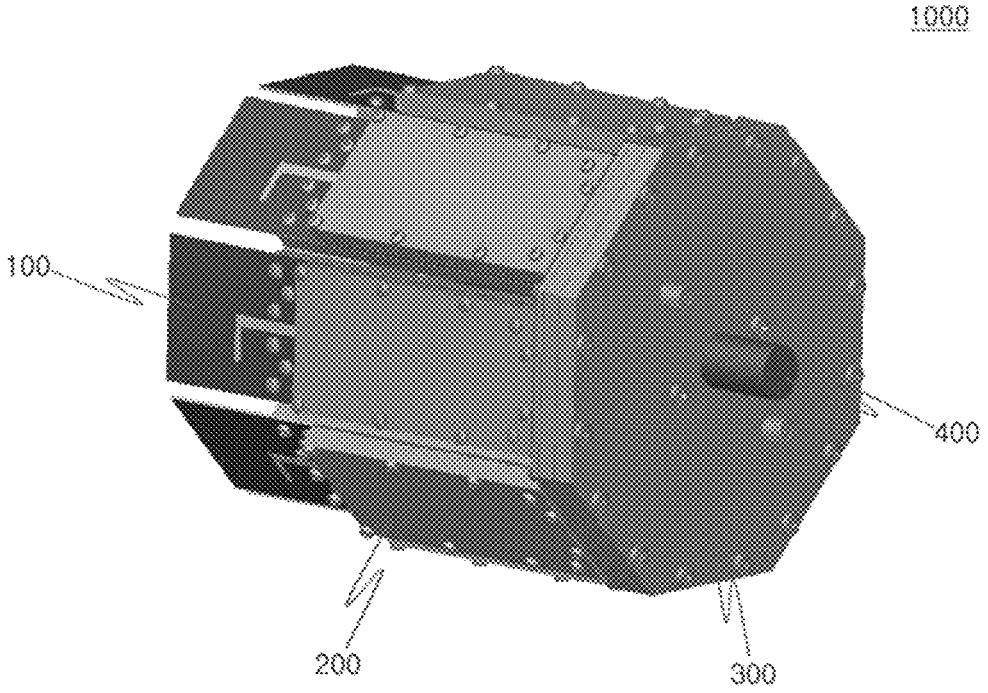
FIGS. 2 and 3 are perspective views illustrating the phased-array antenna of FIG. 1.
Figure 3:
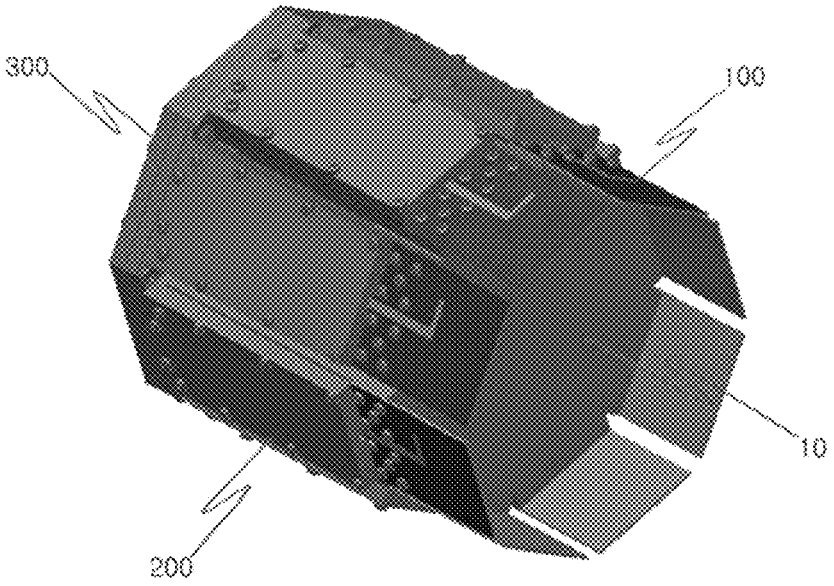
Figure 4:
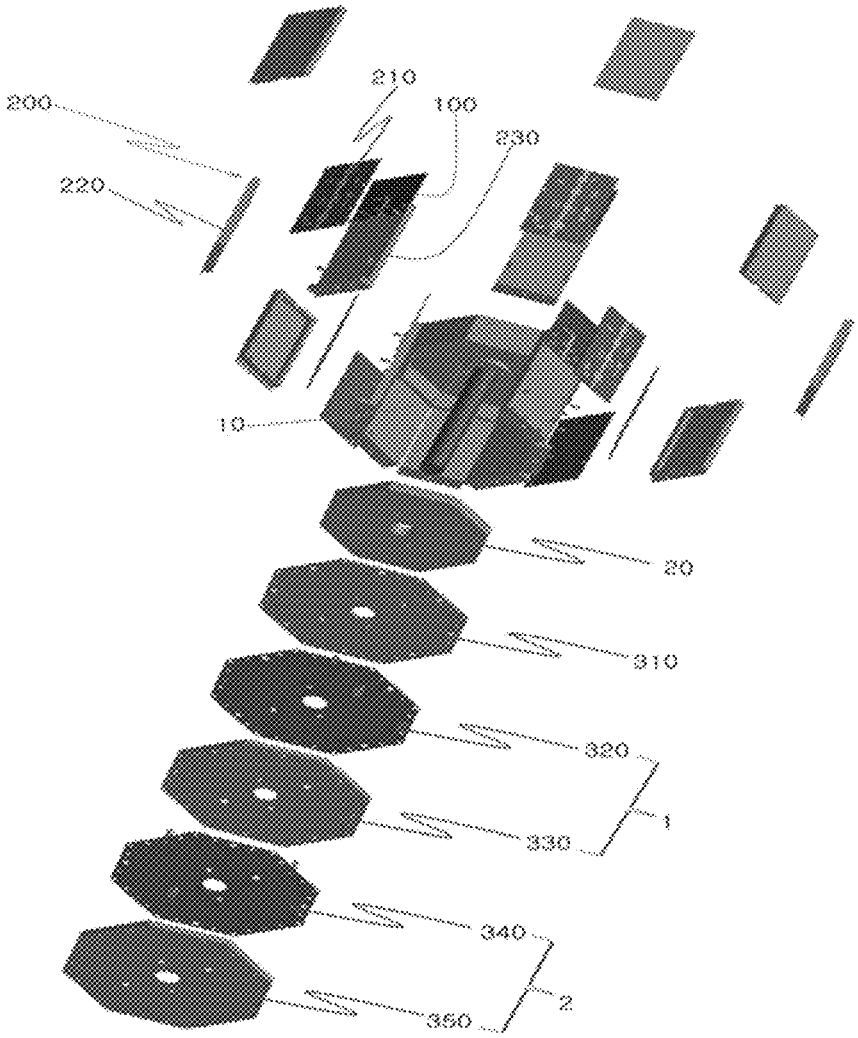
FIG. 4 is an exploded perspective view of the phased-array antenna of FIG. 1.
Figure 5:
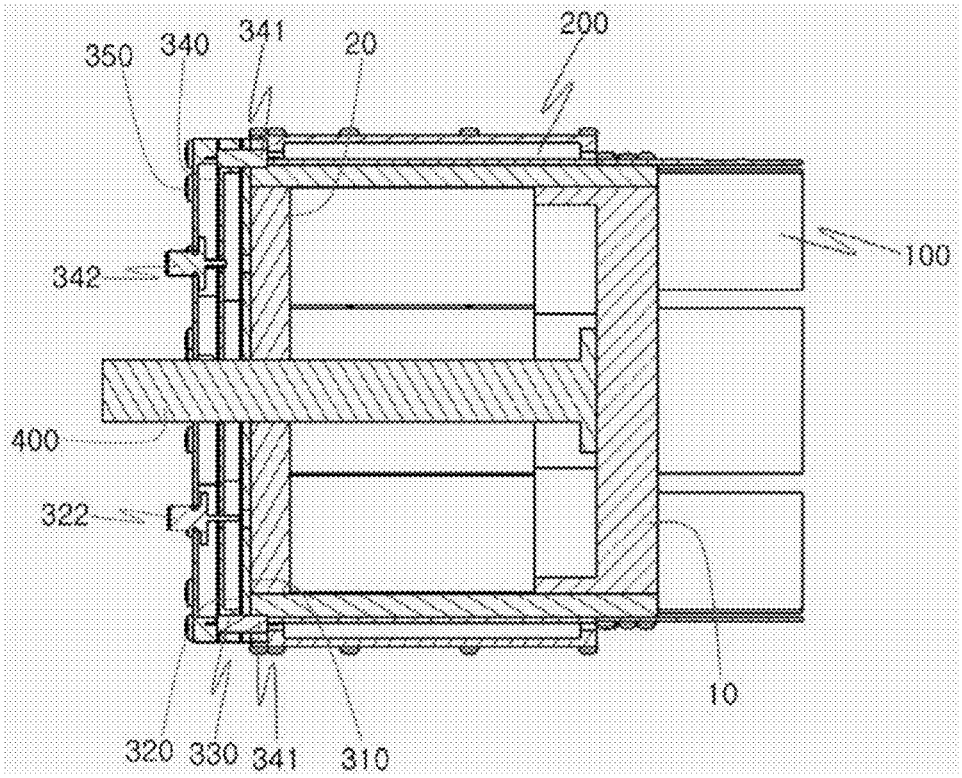
FIG. 5 is a cross-sectional view illustrating the phased-array antenna of FIG. 1.
Figure 6:
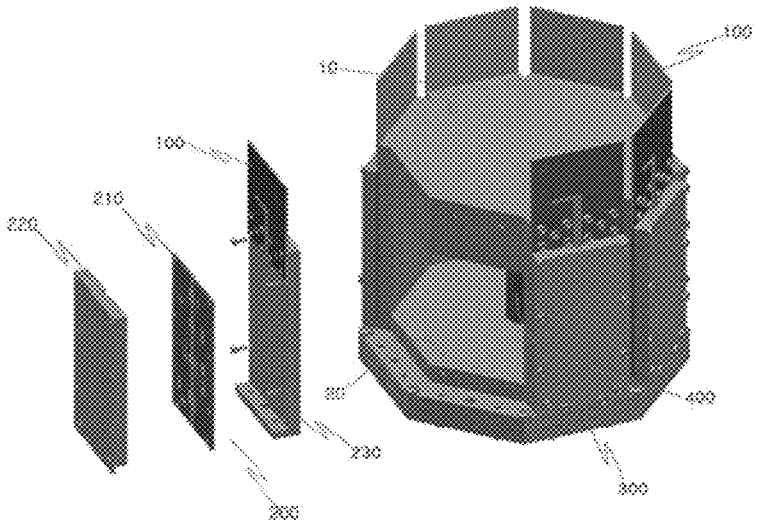
FIG. 6 is an exploded perspective view illustrating an antenna module of the phased-array antenna of FIG. 1.

FIGS. 2 and 3 are perspective views illustrating the phased-array antenna of FIG. 1. FIG. 4 is an exploded perspective view illustrating the phased-array antenna of FIG. 1. FIG. 5 is a cross-sectional view illustrating the phased-array antenna of FIG. 1. FIG. 6 is an exploded perspective view illustrating an antenna module of the phased-array antenna of FIG. 1.

An element antenna 100 may be a patch antenna having a feed line formed therein or an arbitrary antenna. The plurality of element antennas 100 may be implemented by binding the plurality to generate a desired transmission mode.

An antenna module 200 may extends and be disposed in a longitudinal direction to the element antenna 100, and may be provided in the same number as the number of element antennas 100. At this time, the antenna modules 200 may be independently connected to ends of the plurality of element antennas 100, respectively.

Here, the antenna module 200 may include a substrate 210 included in a phase shifter or a phase shifter and amplifying circuit, and an upper case 220 and a lower case 230 housing the substrate 210. In addition, the upper parts of the cases 220 and 230 may be coupled to the element antenna 100, and the lower parts of the cases 220 and 230 may be coupled to the signal distribution module 300. At this time, screw coupling or the like may be used for the coupling.

The signal distribution module 300 may be disposed in a direction perpendicular to the antenna module 200, and one side thereof may be perpendicularly coupled to each of the antenna modules 200. At this time, a phased-array antenna 1000 may include a first supporter 10 and a second supporter 20 configured to support the antenna module 200 perpendicularly coupled to the signal distribution module 300.

The first supporter 10 may couple the element antenna 100 to the lower case 230 of the antenna module 200 for each channel, and the second supporter 20 may perpendicularly couple the antenna module 200 to the signal distribution module 300.

Here, the shape and the size of the first supporter 10, the second supporter 20, and the signal distribution module 300 may be determined by the number of channels of the phased-array antenna. In the embodiment of the present invention, the use of eight channels will be described. In the embodiment of the present invention, since a structure of a multi-mode phased-array antenna using eight channels is described, the first supporter 10, the second supporter 20, and the signal distribution module 300 having an octangular shape are disclosed as shown in FIG. 4. Meanwhile, this should be simply considered as an embodiment, and a shape and size thereof may be easily changed by a designer when the number of channels is changed.

In addition, the antenna module 200 perpendicularly coupled to the signal distribution module 300 may form a three-dimensional space by being perpendicularly coupled to an edge of one side of the signal distribution module 300 with an interval.

At this time, a heat pipe 400 may be provided to effectively dissipate heat generated by the antenna module 200.

The heat pipe 400 may be fixed to the first supporter 10, pass through a through hole **40*h* formed in centers of the three-dimensional space and the signal distribution module 300, and protrude from an outer side of the signal distribution module 300. Therefore, the heat generated by the antenna module 200, and particularly, the amplifying circuit may externally dissipate through the heat pipe 400, and the effect of heat dissipation may be further enhanced by a heat sink 500**.

Meanwhile, the signal distribution module 300 may include at least one of signal distributors 1 and 2. Here, each of the signal distributors 1 and 2 may include a substrate 320 or 340 forming a signal distribution path and a cover 330 or 350 configured to protect and support the substrate 320 or 340. In addition, the signal distribution module 300 may further include a connection part 310 configured to connect and support the signal distribution module 300 and the antenna module 200.

The antenna module 200 may be perpendicularly coupled to the signal distribution module 300 in a longitudinal direction. The connection part 310 may be stacked on a bottom of the antenna module 200 and the second supporter 20. The connection part 310, substrates 320 and 340, and covers 330 and 350 may be screw-coupled to bottoms of the cases 220 and 230 of the antenna module 200.

Here, the number of signal distributors 1 and 2 is determined by a transmission mode to be transmitted. That is, in the above case, since one mode is made by binding four element antennas which are alternately sequenced, two modes are made with eight element antennas. Since the number of antenna modules 200 is eight, two signal distributors may be horizontally stacked and screw-coupled to the signal distribution module 300. In another example, one mode may also be generated using the total of eight element antennas, and in this case, the signal distribution module 300 includes one signal distributor. Thus, the number of modules according to the number of channels may be changed easily, and the sin of the module may be miniaturized, and therefore, the overall size of the phased-array antenna 1000 may also be miniaturized.

At this time, the coupling relation of the signal distribution module 300 including the plurality of signal distributors 1 and 2 and the antenna module 200 may be described with reference to FIGS. 4 to 8. Here, when one mode is made with four element antennas, two signal distributors 1 and 2 may be provided.

Figure 7:
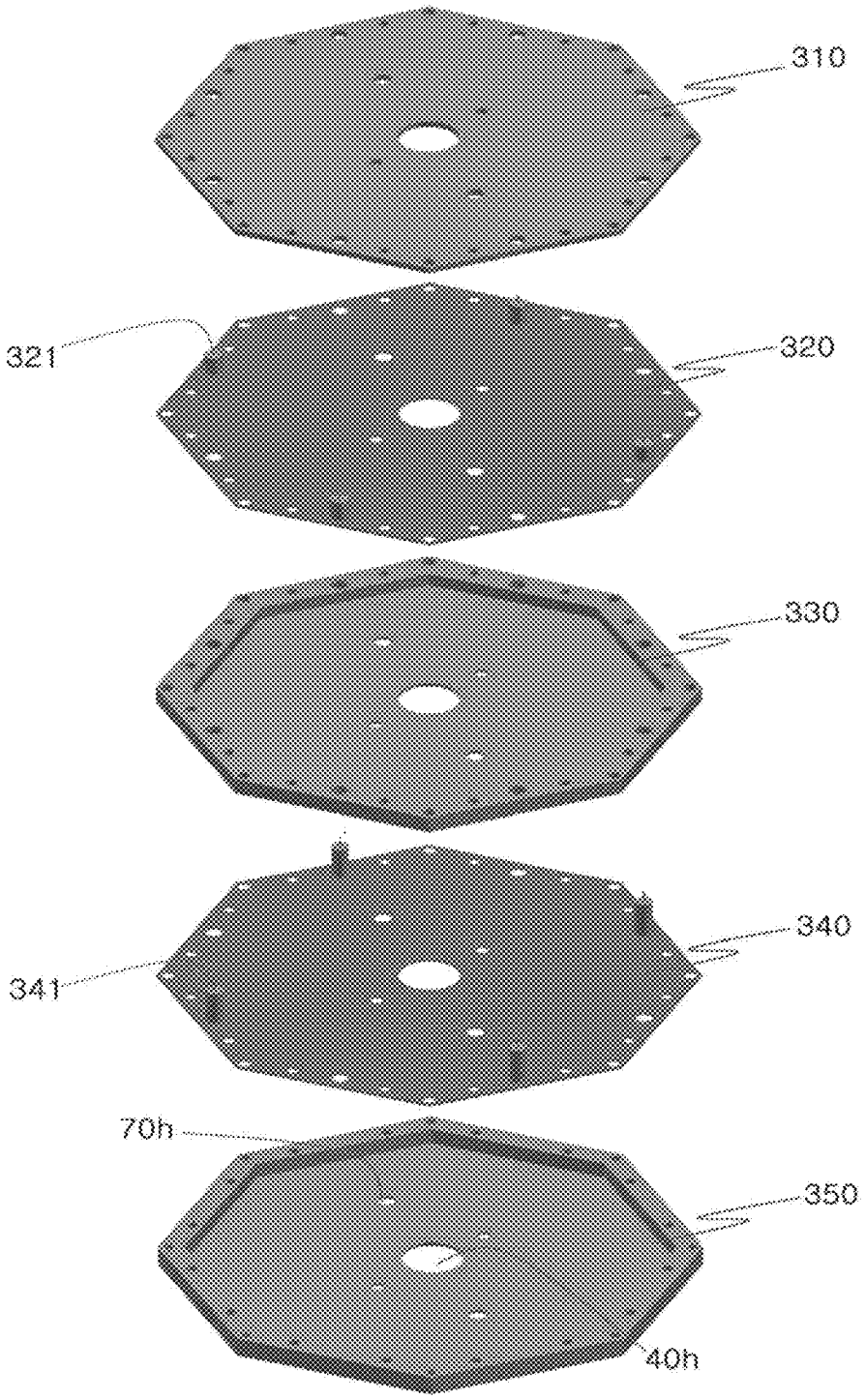
FIG. 7 is an exploded perspective view illustrating a signal distribution module of the phased-array antenna of FIG. 1.
Figure 8:
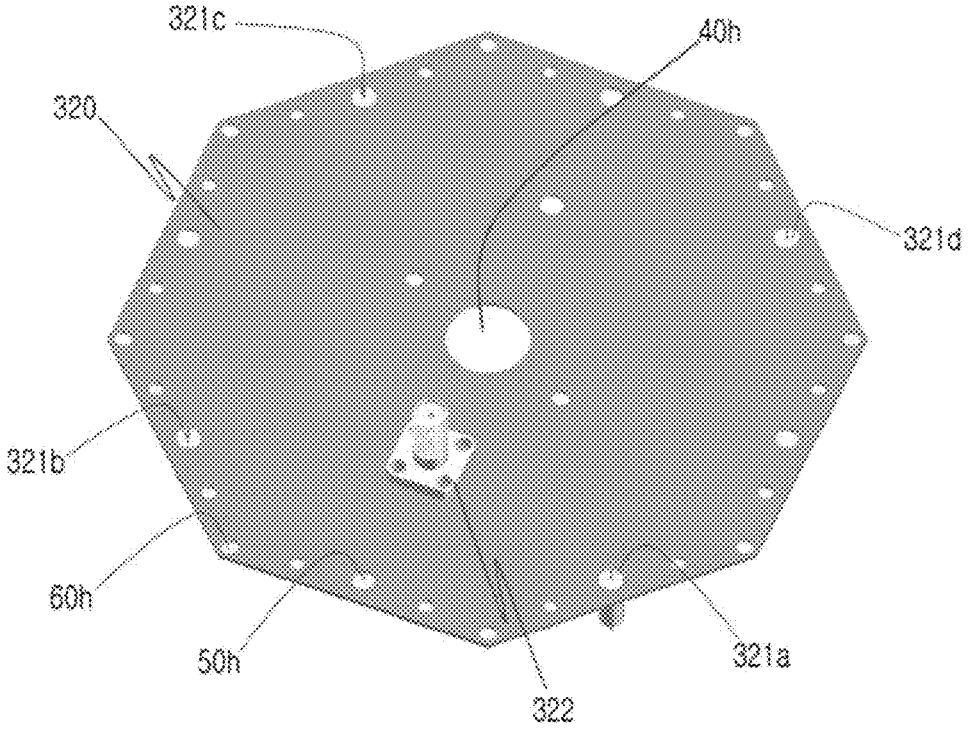
FIG. 8 is a rear view of a first substrate of FIG. 7.
Figure 9:
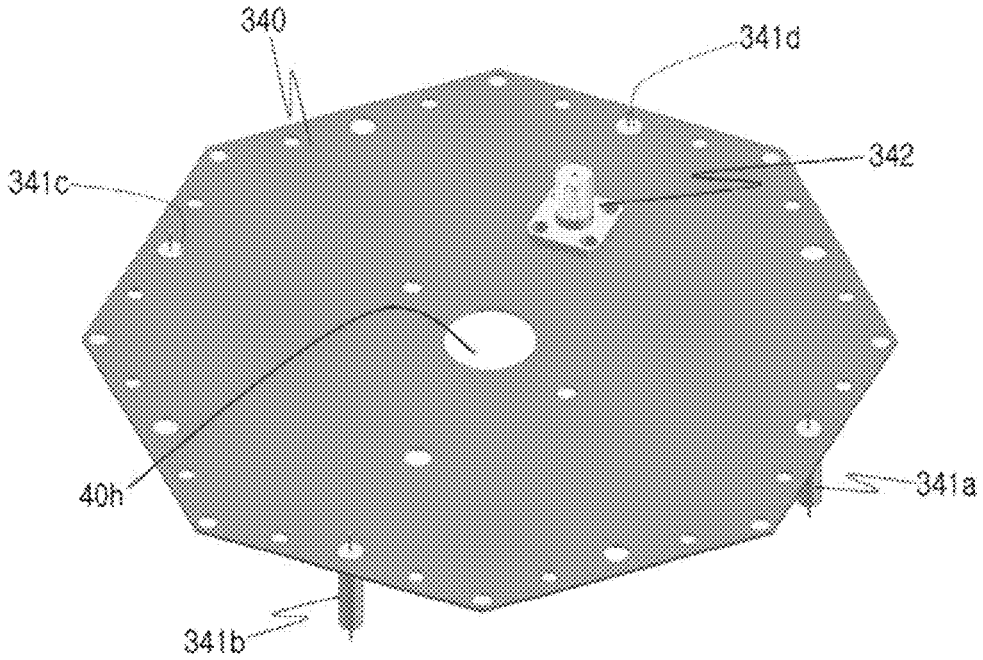
FIG. 9 is a rear view of a second substrate of FIG. 7.

Referring to FIG. 7, a signal distribution module 300 may include a connection part 310, a first substrate 320, a first cover 330, a second substrate 340, and a second cover 350. In addition, the rear surfaces of the first substrate 320 and the second substrate 340 may be shown as FIGS. 8 and 9.

Signal connectors 322 and 342 configured to receive an input signal and connection pins 321 and 341 configured to transmit a distribution signal distributed from the signal connectors 322 and 342 to a corresponding antenna module 200 may be formed on the first substrate 320 and the second substrate 340. Here, the input signal may be a high frequency signal in which a signal from a modem is frequency-modulated, amplified, and output.

In addition, a plurality of circuit pattern paths configured to distribute signals from the signal connectors 322 and 342 to the antenna module 200 may be provided on the first substrate 320 and second substrate 340.

One side of each of the connection pins 321 and 341 may be connected to the circuit pattern path and the other side thereof may be connected to the corresponding antenna module 200, and the connection pins 321 and 341 may transmit the distribution signal which is distributed and phase-delayed through the circuit pattern path formed on the substrates to the corresponding antenna module 200.

Accordingly, the lengths of the connection pins 321 and 341 may be varied according to the location of the stacked substrates 320 and 340. That is, first connection pins 321*a* to 321*d* may have a length from a part coupling to the substrate (phase shifter) 210 of the antenna module 200 to the first substrate 320, second connection pins 341*a* to 341*d* may have a length from the part coupling to the the substrate 210 of the antenna module 200 to the second substrate 340.

In addition, the connection part 310, the first substrate 320, the first cover 330, the second substrate 340, and the second cover 350 may include screw-coupling holes 60*h* for mutual coupling, a heat pipe insertion hole 40*h* having a center in which a heat pipe may be inserted and passed through, and holes in which the first connection pins 321*a* to 321*d*, the second connection pins 341*a* to 341*d*, and the signal connectors 322 and 342 may be inserted and passed through.

Accordingly, it is preferable that the locations of the first connection pins 321*a* to 321*d* and the first signal connector 322 formed in the first substrate 320 be spaced apart from the location of the second connection pins 341*a* to 341*d* and the second signal connector 342 formed in the second substrate 340 to not vertically overlap.

The covers 330 and 350 may be formed in a cover shape having as certain depth and width so as to protect the signal connectors 322 and 342, the circuit pattern path, and the like formed on the first substrate 320 and the second substrate 340.

Thus, the phased-array antenna 1000 according to the embodiment of the present invention may combine and use the plurality of signal distributors, the plurality of antenna modules, and the plurality of element antennas for a multi-mode implementation. At this time, the phased-array antenna 1000 according to the embodiment of the present invention may provide a structure in which a plurality of RF connectors and cables configured to couple each Of the elements is not necessary, that is, the plurality of element antennas 100 and the plurality of antenna modules 200 are three-dimensionally disposed and perpendicularly coupled to the signal distribution module 300 using the connection pins. Therefore, the performance of the phased-array antenna 1000 can be improved by reducing a loss generated from the plurality of RF connectors and cables.

As described above, the phased-array antenna according to the embodiment of the present invention has a structure in which the plurality of element antennas and antenna modules are three-dimensionally disposed and perpendicularly coupled to the signal distribution module using connection pins, and therefore, the RF connector and cable configured to couple each of the elements are not necessary. Then, the performance of the phased-array antenna can be improved by reducing a loss. In addition, the size of the phased-array antenna can be miniaturized by decreasing the number of components, and cost can be reduced.

In addition, since the signal distribution module is implemented in a structure in which a plurality of signal distributors are horizontally stacked, the number of elements thereof is changed easily, and a plurality of modes can be implemented with the size miniaturized.

In addition, the heat generated from the amplifying element of the antenna module can dissipate through the heat pipe.

The above-described exemplary embodiments of the present invention are only examples and it will be understood by those skilled in the art that various modifications, alternations, and additions may be made without departing from the spirit and scope of the invention. Therefore, the modifications, alternations, and additions fall within the scope of the accompanying claims of the present invention.

What is claimed is:

1. A phased-array antenna comprising:

a plurality of element antennas having feed lines formed thereon;

antenna modules, which includes a phase shifter or a phase shifter and amplifying circuit, configured to extend and be disposed in longitudinal directions of the element antennas, and independently connected to one ends of the plurality of element antennas, respectively; and a signal distribution module disposed in a direction perpendicular to the antenna modules, having one side surface being perpendicularly connected to each of the antenna modules, and configured to distribute an input signal to the corresponding antenna module through connection pins whose one sides are respectively connected to the antenna modules.

2. The phased-array antenna of claim 1, wherein in the signal distribution modules, the number of signal distributors the same as the number of transmission modes to be transmitted by the phased-array antenna are stacked and screw-coupled.

3. The phased-array antenna of claim 2, wherein each of the signal distributors comprises:

a substrate having a signal connector configured to receive the input signal and connection pins which transmit distribution signals distributed from the signal connector to the corresponding antenna modules; and a cover stacked on the substrate to project and support the substrate, wherein the substrate and cover are screw-coupled.

4. The phased-array antenna of claim 3, wherein, in the signal distributors, one side of the connection pin formed on the substrate is coupled to the corresponding antenna module, and the signal connector passes and is exposed through the cover formed on an outermost side thereof.

5. The phased-array antenna of claim 3, wherein locations of the connection pins and the signal connector formed on each substrate of the signal distributors do not vertically overlap and are spaced apart from each other.

6. The phased-array antenna of claim 1, further comprising a heat pipe, wherein the plurality of antenna modules are spaced apart from each other and perpendicularly coupled to an edge of one side surface of the signal distribution module to form a three-dimensional space, and the heat pipe passes through the three-dimensional space and the signal distribution module and protrudes from an outer side of the signal distribution module.

* * * * *